US010490139B2

(12) United States Patent
Zha

(10) Patent No.: US 10,490,139 B2
(45) Date of Patent: Nov. 26, 2019

(54) DISPLAY DRIVING METHOD AND RELATED APPARATUS

(71) Applicant: Wuhan China Star Optoelectronics Technology Co., Ltd., Wuhan, Hubei (CN)

(72) Inventor: Guowei Zha, Guangdong (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 48 days.

(21) Appl. No.: 15/740,301

(22) PCT Filed: Nov. 27, 2017

(86) PCT No.: PCT/CN2017/113122
§ 371 (c)(1),
(2) Date: Dec. 27, 2017

(87) PCT Pub. No.: WO2019/085100
PCT Pub. Date: May 9, 2019

(65) Prior Publication Data

US 2019/0130850 A1 May 2, 2019

(30) Foreign Application Priority Data

Oct. 31, 2017 (CN) ..... 2017 1 1046389

(51) Int. Cl.
*G09G 3/34* (2006.01)
*G09G 3/36* (2006.01)

(52) U.S. Cl.
CPC ..... *G09G 3/3406* (2013.01); *G09G 3/3607* (2013.01); *G09G 2320/0233* (2013.01); *G09G 2320/0626* (2013.01)

(58) Field of Classification Search
CPC . G02F 1/133; G09G 3/20; G09G 3/34; G09G 3/36; G09G 3/3406;
(Continued)

(56) References Cited

U.S. PATENT DOCUMENTS

2013/0069924 A1* 3/2013 Robinson ..... G09G 3/20 345/207
2016/0140906 A1* 5/2016 Choi ..... G09G 3/3406 345/207
(Continued)

FOREIGN PATENT DOCUMENTS

CN 101727843 A 6/2010
CN 103295553 A 9/2013
(Continued)

*Primary Examiner* — Nelson M Rosario
(74) *Attorney, Agent, or Firm* — Hemisphere Law, PLLC; Zhigang Ma

(57) ABSTRACT

A display driving method and a related apparatus are provided. The method includes following steps: determining n backlight brightness values respectively corresponding to n pixel positions of a screen-locked display area when the screen-locked display area lighting, wherein n is an integer greater than 1; determining n grayscale compensation values respectively corresponding to the n backlight brightness values in accordance with the n backlight brightness values and a grayscale compensation formula; driving liquid crystal molecules with corresponded deflection according to the n grayscale compensation values. The display driving method and the related apparatus disclosed in this disclosure can control the screen brightness of whole screen-locked display consistent.

14 Claims, 3 Drawing Sheets

(58) Field of Classification Search
CPC ..... G09G 2320/062; G09G 2360/144; H04N 5/66; H04M 1/22; H04M 2250/12; H04M 1/725; G06F 1/16
See application file for complete search history.

(56) References Cited

U.S. PATENT DOCUMENTS

| | | | | |
|---|---|---|---|---|
| 2016/0343326 | A1* | 11/2016 | Li | G02F 1/13338 |
| 2017/0061897 | A1* | 3/2017 | Zhang | G09G 3/3426 |

FOREIGN PATENT DOCUMENTS

| | | | |
|---|---|---|---|
| CN | 105139809 | A | 12/2015 |
| CN | 106340272 | A | 1/2017 |
| CN | 106681675 | A | 5/2017 |
| JP | 2011013422 | A | 1/2011 |

* cited by examiner

DISPLAY DRIVING METHOD AND RELATED APPARATUS

RELATED APPLICATIONS

The present application is a National Phase of International Application Number PCT/CN2017/113122, filed on Nov. 27, 2017, and claims the priority of China Application No. 201711046389.3, filed on Oct. 31, 2017.

FIELD OF THE DISCLOSURE

The disclosure relates to a liquid crystal display field, and more particularly to a display driving method and a related apparatus.

BACKGROUND

In this modern society, an interface connected the human with display is the important way of sharing the information with other people. Due to the excellent screen reproducibility, a liquid crystal display (LCD) has become the mainstream in display field. The basic principle of the LCD is irradiating the liquid crystal cell by a backlight module. By a change of polarization in respect with the TFT array driving liquid crystal molecules, the liquid crystal cell achieves that controlling the size of the grayscale by the light valve. The display is always on a screen-off state under an irregular work mode, but the requests of displaying time, messages and other SMS features are gradually demanded to people.

In general, most of the information displayed on the screen is usually being white text or colored text, and the grayscale value of the liquid crystal molecules are almost around the largest value. So that means the liquid crystal molecules are always on the state of maximum angle of deflection, which causes the liquid crystal molecules curing and influences the physicochemical properties of the liquid crystal molecules and alignment layers.

SUMMARY

A display driving method and a related apparatus are disclosed in this disclosure, which controls the screen brightness of whole screen-locked display consistent.

In one aspect, a display driving method provided by an embodiment of this disclosure, includes:

determining n backlight brightness values respectively corresponding to n pixel positions of a screen-locked display area when the screen-locked display area lights up, wherein n is an integer greater than 1;

determining n grayscale compensation values respectively corresponding to the n backlight brightness values in accordance with the n backlight brightness values and a grayscale compensation formula; and driving liquid crystal molecules with corresponded deflection according to the n grayscale compensation values.

In second aspect, a display driving apparatus provided by an embodiment of this disclosure, includes:

a determination unit, configured for determining n backlight brightness values respectively corresponding to n pixel positions of a screen-locked display area when the screen-locked display area lights up, wherein n is an integer greater than 1; determining n grayscale compensation values respectively corresponding to the n backlight brightness values in accordance with the n backlight brightness values and a grayscale compensation formula; and a driving unit, configured for driving liquid crystal molecules with corresponded deflection according to the n grayscale compensation values.

In third respect, a display driving apparatus provided by an embodiment of this disclosure, includes: at least one processor, at least one storage, at least one transceiver, and at least one program, wherein the at least one program is stored in the at least one storage and executed by the at least one processor, and the at least one program comprises instructions of step executed in the display driving method according to the one aspect.

In fourth aspect, a liquid crystal display provided by an embodiment of this disclosure. The liquid crystal display is driven by a display driving method according to the one aspect. The backlight brightness value is periodic changed when the liquid crystal display lights on a screen-locked state and each liquid crystal molecule corresponding to the pixel position are driven with the corresponded deflection by the grayscale compensation value.

In fifth aspect, a computer-readable storage medium provided by an embodiment of this disclosure. The computer-readable storage medium stores a computer program used for inter-exchanging electric data, wherein the computer executes the display driving method according to the one aspect by the computer program.

In sixth aspect, a computer program product provided by an embodiment of this disclosure. The computer program product includes a non-transitory computer-readable storage media storing a computer program. The computer executes the display driving method according to the one aspect by the computer program.

In this disclosure, first, n backlight brightness values respectively corresponding to n pixel positions of a screen-locked display area are determined when the screen-locked display area lights up; then, n grayscale compensation values respectively corresponding to the n backlight brightness values are determined in accordance with the n backlight brightness values and a grayscale compensation formula; finally, liquid crystal molecules with corresponded deflection are driven according to the n grayscale compensation values. Obviously, the display driving method and the related apparatus disclosed in this disclosure can control the screen brightness of whole screen-locked display consistent.

These and other aspects of the present disclosure will be more readily understood from the description of the embodiments following.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

In order to make the person skilled in the art better understand the purpose of this disclosure, the specific structural and functional details of the embodiments of this disclosure in combination with the figures are clear and completely described hereinafter. However, the specific structural and functional details disclosed herein are only representative and are intended for describing exemplary embodiments of the disclosure. Thus, the disclosure can be embodied in many forms of substitution, and should not be interpreted as merely limited to the embodiments described herein. Based on the embodiments of this disclosure, other concerned embodiments that the ordinary skilled in the art can obviously implement without creative effort are within the scope of this disclosure.

The detail description is illustrated as following.

The disclosure specification, drawings, and terms that appear in the "first", "second", "third" and "fourth," etc. are used to distinguish between different objects, and not for describing a particular sequential claims. Furthermore, the terms "including" and "having," and any modification thereof, are intended to cover non-exclusive inclusion. For example, comprising a series of steps or unit process, method, system, or apparatus or unit is not limited to the listed steps, but optionally further includes the step or unit is not listed, or alternatively further comprising for such process, method, article, or apparatus-specific steps or other units.

Referred to herein, "an embodiment" means that a particular feature of the described embodiments, structures or characteristics may comprise at least one embodiment of the disclosure. Various places in the specification are not necessarily all appear phrase referring to the same embodiment, nor are separate or alternative embodiments mutually exclusive of other embodiments of the embodiments. The ordinary skilled in the art implicitly and explicitly understood that the embodiments described herein may be combined with other embodiments.

Hereinafter, the term in this application is a part of the explanation to be understood to the ordinary skilled in the art. The terminal apparatus, also known as a user equipment (User Equipment, UE), is an apparatus providing voice and/or data connectivity to a user apparatus, e.g., having a handheld wireless connection capability equipment, automotive equipment. The common terminals, for example, include mobile phones, tablet PCs, laptops, PDAs, mobile Internet apparatuses (mobile internet apparatus, MID), wearable apparatuses, such as smart watches, smart bracelet, pedometer and so on.

Figure 1:
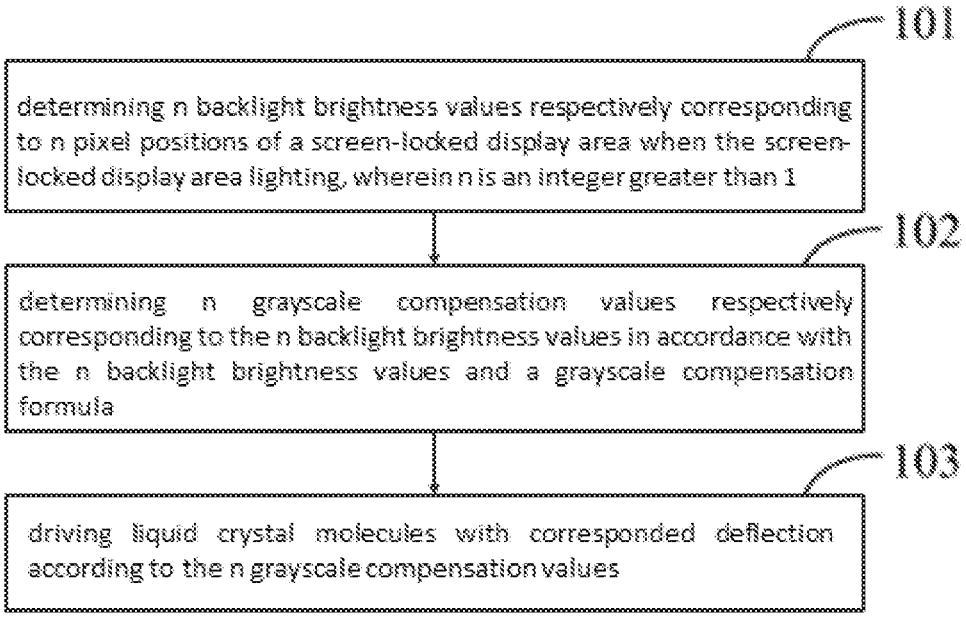
FIG. 1 is a schematic flowchart of a display driving method according to an embodiment of the disclosure.

Reference is made to FIG. 1, which is a schematic flowchart of a display driving method according to an embodiment of the disclosure. The display driving method can be operated by a terminal apparatus or a display driving apparatus having a liquid crystal display. Following is described by the display driving apparatus. The display driving method includes:

STEP 101: determining n backlight brightness values respectively corresponding to n pixel positions of a screen-locked display area when the screen-locked display area lights up, wherein n is an integer greater than 1.

The screen-locked display area is meant that the partial area of the screen stays on lighting, such as display of time, incoming information, and pushing messages, etc.

The location of the screen-locked display area can be fixed or flexible. When displays time on a screen-locked state, the screen-locked display area is displayed and located on the upper part of the screen of the display driving apparatus; when displays pushing messages on the screen-locked state, the screen-locked display area is displayed and located on the middle part of the screen of the display driving apparatus In some embodiments, the step of the display driving apparatus determines the n backlight brightness values respectively corresponding to the n pixel positions of the screen-locked display area, further includes following steps:

numbering the n pixel positions; and determining the n backlight brightness values respectively corresponding to the n pixel positions of the screen-locked display area in accordance with the number of the n pixel positions.

Figure 2:
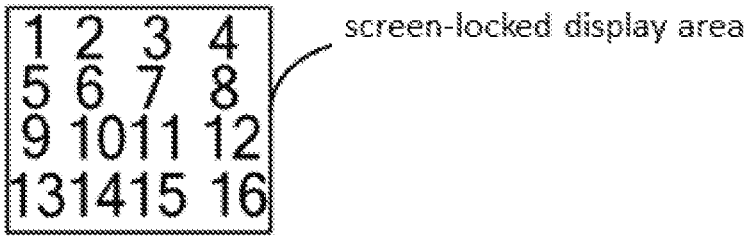
FIG. 2 is a schematic view of numbering pixel positions of a screen-locked area according to the embodiment of the disclosure.

For example, if assumed that n is 16, the display driving apparatus numbers the 16 pixel positions of the screen-locked display area from 1 to 16 (shown as FIG. 2). The display driving apparatus determining the 16 backlight brightness values respectively corresponding to the 16 pixel positions of the screen-locked display area according to the number of those pixel positions (shown as Table 1).

TABLE 1

| pixel position | backlight brightness value (lux) |
|---|---|
| 1 | 80 |
| 2 | 82 |
| 3 | 84 |
| 4 | 86 |
| 5 | 82 |
| 6 | 84 |
| 7 | 86 |
| 8 | 88 |
| 9 | 84 |
| 10 | 86 |
| 11 | 88 |
| 12 | 90 |
| 13 | 86 |
| 14 | 88 |
| 15 | 90 |
| 16 | 92 |

In some embodiments, the step of the display driving apparatus determines the n backlight brightness values respectively corresponding to the n pixel positions of the screen-locked display area, further includes following steps:

The screen-locked display area are configured into M blocks, each block having a plurality of the pixel positions, total of the M blocks having the n pixel positions, wherein M is integer than 1, a backlight brightness value of one pixel position within the block I is determined, wherein the block i is any one of the M blocks; and all backlight brightness values of the pixel positions within the block i are set by the backlight brightness value of one pixel position within the block i.

Figure 3:
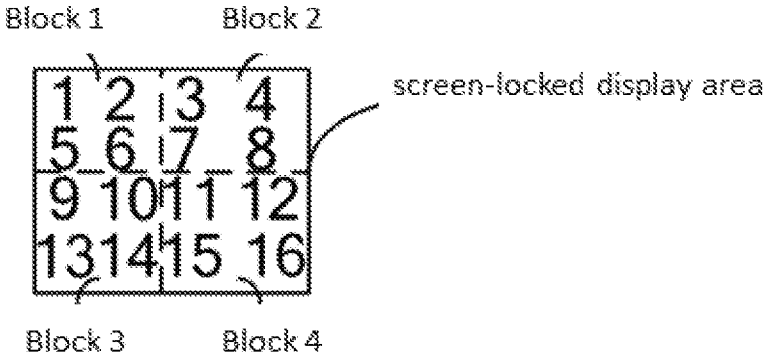
FIG. 3 is a schematic view of configuring the screen-locked area according to the embodiment of the disclosure.

For example, shown as FIG. 3, the display driving apparatus configures the 16 pixel positions of the screen-locked display area into 4 blocks (e.g., block 1, block 2, block 3, and block 4). The block 1 includes 4 pixel positions of 1, 2, 5 and 6; the block 2 includes 4 pixel positions of 3, 4, 7 and 8; the block 3 includes 4 pixel positions of 9, 10, 13 and 14, and the block 4 includes 4 pixel positions of 11, 12, 15 and 16. If the backlight brightness value of pixel position 1 of the block 1 is determined to be 80 lux, the backlight brightness value of pixel position 3 of the block 2 is determined to be 84 lux, the backlight brightness value of pixel position 9 of the block 3 is determined to be 84 lux and the backlight brightness value of pixel position 11 of the block 4 is determined to be 88 lux, the display driving apparatus determines the block 1 determines the backlight brightness value of the block 1 to be 80 lux, the backlight brightness value of the block 2 to be 84 lux, the backlight brightness value of the block 3 to be 84 lux, and the backlight brightness value of the block 4 to be 88 lux.

However, the method of determining the backlight brightness value corresponding to the pixel position of the screen-locked display area by the display driving apparatus is known by the ordinary skilled in the art, so it is omitted herein.

STEP 102, n grayscale compensation values respectively corresponding to the n backlight brightness values are determined in accordance with the n backlight brightness values and a grayscale compensation formula.

In some embodiments, the grayscale compensation formula is:

$$Gray_{nm}=Blu_{1n}*Gray_{1n}/Blu_{mn}$$

Wherein, m∈[1, N], the $Gray_{mn}$ is the grayscale compensation value of the backlight brightness level m and the pixel position n, the $Blu_{1n}$ is the backlight brightness value of the backlight brightness level 1 and the pixel position n, the $Gray_{1n}$ is the grayscale compensation value of the backlight brightness level 1 and the pixel position n, the $Blu_{nm}$ is the backlight brightness value of the backlight brightness level m and the pixel position n.

In some embodiments, when the backlight brightness level is 1, the display driving apparatus determines the grayscale compensation values $Gray_{1n}$ respectively corresponding to the n pixel positions. Shown as Table 2 following:

TABLE 2

| pixel position | grayscale compensation value $Gray_{1n}$ |
|---|---|
| 1 | $Gray_{11}$ = 227 |
| 2 | $Gray_{12}$ = 225 |
| 3 | $Gray_{13}$ = 223 |
| 4 | $Gray_{41}$ = 221 |
| ⋮ | ⋮ |
| n | $Gray_{1n}$ = 203 |

For example, assumed that the n is 16, when the backlight brightness level is 1, the display driving apparatus determines the 16 backlight brightness values corresponding to the 16 pixel positions of the screen-locked display area to respectively be 80 lux, 82 lux, 84 lux, 86 lux, 82 lux, 84 lux, 86 lux, 88 lux, 84 lux, 86 lux, 88 lux, 90 lux, 86 lux, 88 lux, 90 lux, and 92 lux. According to Table 2, the display driving apparatus determines the 16 grayscale compensation values corresponding to the 16 pixel positions respectively as 227, 225, 223, 221, 225, 223, 221, 219, 223, 221, 219, 217, 221, 219, 217, and 215, when the backlight brightness level is 3, the display driving apparatus determines the 16 backlight brightness values corresponding to the 16 pixel positions of the screen-locked display area to respectively be 84 lux, 86 lux, 88 lux, 90 lux, 86 lux, 88 lux, 90 lux, 92 lux, 88 lux, 90 lux, 92 lux, 94 lux, 90 lux, 92 lux, 94 lux, and 96 lux. According to the grayscale compensation formula ($Gray_{mn}=Blu_{1n}*Gray_{1n}/Blu_{mn}$), the display driving apparatus determines the 16 grayscale compensation values corresponding to the 16 pixel positions respectively as 216, 215, 213, 211, 215, 213, 211, 209, 213, 211, 209, 208, 211, 209, 208, and 206. When the backlight brightness level is 3, the grayscale compensation value (213) corresponding to backlight brightness value of the pixel position 3 is calculated according to the values of 84 lux ($Blu_{13}$), 223 ($Gray_{13}$), 88 lux ($Blu_{33}$), and the compensation formula ($Gray_{33}=Blu_{13}*Gray_{13}/Blu_{33}$).

STEP 103, liquid crystal molecules liquid crystal molecules with corresponded deflection are driven according to the n grayscale compensation values.

In some embodiment, the step of driving liquid crystal molecules with corresponded deflection by the display driving apparatus according to the n grayscale compensation values, further includes;

determining n grayscale integer values respectively corresponding to the n grayscale compensation values in accordance with the n grayscale compensation values and a grayscale transformation formula;

transforming then grayscale integer values into n driving voltage parameters corresponding to the n grayscale integer values; and driving the liquid crystal molecules with corresponded deflection according to the n driving voltage parameters.

However, the method of transforming the grayscale integer value into the driving voltage parameter corresponding to the grayscale integer values by the D/A conversion is known by the ordinary skilled in the art, so it is omitted herein.

In some embodiment, the grayscale transformation formula is:

$$G=Gray_{mn}^{1/gamma}*B$$

Wherein, the G is the grayscale integer value, and the $Gray_{mn}$ is the grayscale compensation value of the backlight brightness level m and the pixel position n. The gamma is the gamma index of display, the B is number of bits.

For example, if the gamma is assumed as 2 and the B is 4 bits, the display driving determines the grayscale compensation value as 216 of the backlight brightness level 3 and the pixel position 1, and determines the grayscale integer value as 235 according to the grayscale transformation formula $G=Gray_{mn}^{1/2}*2^4$.

Moreover, if the gamma is assumed as 2 and the B is 4-bits, when the backlight brightness level is 3, the display driving apparatus determines the 16 backlight compensation values corresponding to the 16 backlight brightness values corresponding to the 16 pixel positions of the screen-locked display area to respectively be 216, 215, 213, 211, 215, 213, 211, 209, 213, 211, 209, 208, 211, 209, 208 and 206, and determines the 16 grayscale integer values corresponding to the grayscale transformation formula $G=Gray_{mn}^{1/2}*2^4$ respectively as 235, 235, 234, 232, 235, 234, 232, 231, 234, 232, 231, 231, 232, 231, 231 and 230. The display driving apparatus transforms the 16 grayscale integer values into 16 driving voltage parameters corresponding to the 16 grayscale integer values, and drives the liquid crystal molecules with corresponded deflection according to the 16 driving voltage parameters.

In this disclosure, first, n backlight brightness values respectively corresponding to n pixel positions of a screen-locked display area are determined when the screen-locked display area lights up; then, n grayscale compensation values respectively corresponding to the n backlight brightness values are determined in accordance with the n backlight brightness values and a grayscale compensation formula; finally, liquid crystal molecules with corresponded deflection are driven according to the n grayscale compensation values. The screen brightness of the screen-locked display area is determined by the product of the backlight brightness values of the pixel positions and transmittances corresponding to the grayscale compensation values. For the same pixel position, the grayscale compensation value is large in response to the backlight brightness value is small, and the grayscale compensation value is small in response to the backlight brightness value is large. Even though the pixel position in different backlight brightness levels, the products of the backlight brightness values of the same pixel position and transmittances corresponding to the grayscale compensation values are the same. Thus, the display driving method disclosed above can control the screen brightness of whole screen-locked display consistent.

In some embodiments, the display driving apparatus includes a backlight brightness sequence. The backlight brightness sequence includes N backlight levels in respect with the screen-locked display area, and N is an integer greater than 1. Under a first backlight level of the N backlight levels, pixel position i is corresponding to backlight brightness value j, and the backlight brightness value j is corresponding to grayscale compensation value k. Under a second backlight level of the N backlight levels, the pixel position i corresponds to backlight brightness value x, and the backlight brightness value x corresponds to grayscale compensation value y. The product of the backlight brightness value j and a transmittance corresponding to the grayscale compensation value k is equal to the product of the backlight brightness value x and a transmittance corresponding to the grayscale compensation value y, the first backlight level and the second backlight level are any two levels of the N backlight levels, and the pixel position i is any one of the n pixel positions.

For example, assumed that the backlight brightness level is 1, the display driving apparatus determines the backlight brightness value j (e.g., 82 lux) corresponding to the pixel position 2, and the display driving apparatus determines the grayscale compensation value k (e.g., 225) corresponding to the backlight brightness value j (e.g., 82 lux). Assumed that the backlight brightness level is 3, the display driving apparatus determines the backlight brightness value x (e.g., 86 lux) corresponding to the pixel position 2, and the display driving apparatus determines the grayscale compensation value y (e.g., 215) corresponding to the backlight brightness value x (e.g., 86 lux). The display driving apparatus determines that the product of the backlight brightness value j (e.g., 82 lux) and a transmittance corresponding to the grayscale compensation value k (e.g., 225) is equal to the product of the backlight brightness value x (e.g., 86 lux) and a transmittance corresponding to the grayscale compensation value y (e.g., 215). An error region could be ignored, which is due to the integer of the grayscale compensation value. That is, the grayscale compensation value is calculated according to the grayscale compensation formula by rounding.

Thus, in this disclosure, even though the pixel position in any two backlight brightness levels, the products of the backlight brightness values of the same pixel position and transmittances corresponding to the grayscale compensation values are the same. The display driving method disclosed above can control the screen brightness of whole screen-locked display consistent.

In some embodiments, the backlight brightness sequence is configured in order by the N backlight brightness levels; the backlight brightness levels of the screen-locked display area are configured in a loop according to the backlight brightness sequence by the display driving apparatus; the lighted-up durations of different backlight brightness levels in respect with the screen-locked display area are the same.

The order can be numbered from small to large, or large to small, and it is not limited thereto.

The lighted-up durations of different backlight brightness levels in respect with the screen-locked display area can be expressed as T, and the T far greater than 1/60s, such as 1/20, 1/15, 1/10, 1/5, 1/2, or etc.

For example, assumed that N is 4, T=1/5, the backlight brightness levels are ordered from a backlight brightness level 1 to a backlight brightness level 4, wherein the backlight brightness level 1< the backlight brightness level 2< the backlight brightness level 3< the backlight brightness level 4. The backlight brightness level of the screen-locked display area is changed to the next backlight brightness level with every 1/5 s. For example, if the screen-locked display area is currently on the backlight brightness level 4, the backlight brightness level 4 will be changed to the backlight brightness level 1 after 1/5 s.

The backlight brightness value of the screen-locked display area is periodic changed, and the backlight brightness value within the screen-locked display area is also periodic changed. Thus, the grayscale compensation value corresponding to the backlight brightness value is also periodic changed. However, the method disclosed can prevent the liquid crystal molecules from solidifying for a long time and the properties of the alignment layer material from deteriorating.

The method of this disclosure is described above, and an apparatus are disclosed as following.

Figure 4:
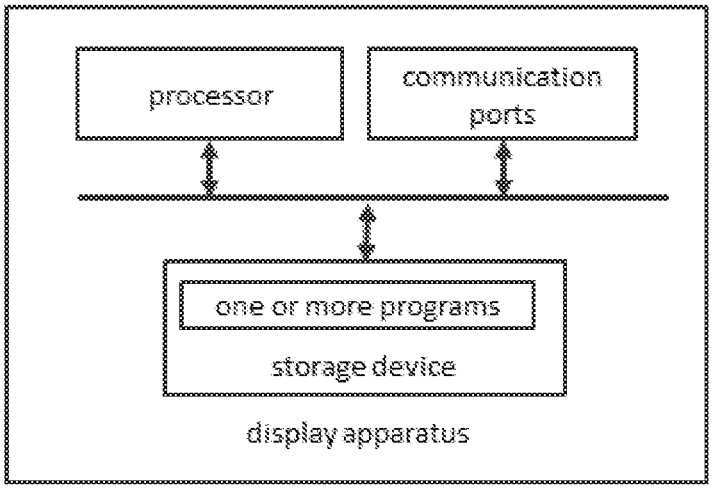
FIG. 4 is a structural schematic view of a display driving apparatus according to an embodiment of the disclosure.

Reference is made to FIG. 4, which is a display driving apparatus 400 disclosed in this disclosure. The display driving apparatus 400 includes at least one processor, at least one storage, at least one transceiver, and at least one program.

Wherein the at least one program is stored in the at least one storage and executed by the at least one processor, and the at least one program includes instructions of executing following steps:

determining n backlight brightness values respectively corresponding to n pixel positions of a screen-locked display area when the screen-locked display area lights up, wherein n is an integer greater than 1;

determining n grayscale compensation values respectively corresponding to the n backlight brightness values in accordance with the n backlight brightness values and a grayscale compensation formula; and driving liquid crystal molecules with corresponded deflection according to the n grayscale compensation values.

In some embodiments, the at least one program includes instructions of executing following steps.

A display driving apparatus includes a backlight brightness sequence, the backlight brightness sequence comprises N backlight levels in respect with the screen-locked display area, N is an integer greater than 1; under a first backlight level of the N backlight levels, pixel position i is corresponding to backlight brightness value j, and the backlight brightness value j is corresponding to grayscale compensation value k; under a second backlight level of the N backlight levels, the pixel position i corresponds to backlight brightness value x, and the backlight brightness value x corresponds to grayscale compensation value y; the product of the backlight brightness value j and a transmittance corresponding to the grayscale compensation value k is equal to the product of the backlight brightness value x and a transmittance corresponding to the grayscale compensation value y, the first backlight level and the second backlight level are any two levels of the N backlight levels, and the pixel position i is any one of the n pixel positions.

In some embodiments, the at least one program includes instructions of executing following steps.

The backlight brightness sequence is configured in order by the N backlight brightness levels; the backlight brightness levels of the screen-locked display area are configured in a loop according to the backlight brightness sequence by the display driving apparatus; the lighted-up durations of different backlight brightness levels in respect with the screen-locked display area are the same.

In some embodiments, the display driving apparatus determines the n backlight brightness values respectively corresponding to the n pixel positions of the screen-locked display area, the at least one program includes instructions of executing following steps:

The n pixel positions are numbered; and the n backlight brightness values respectively corresponding to the n pixel positions of the screen-locked display area are determined in accordance with the number of the n pixel positions.

In some embodiments, the display driving apparatus determines the n backlight brightness values respectively corresponding to the n pixel positions of the screen-locked display area, the at least one program includes instructions of executing following steps:

the screen-locked display area is configured into M blocks, each block having a plurality of the pixel positions, total of the M blocks having the n pixel positions, wherein M is integer than 1; a backlight brightness value of one pixel position within the block I is determined, wherein the block i is any one of the M blocks; and all backlight brightness values of the pixel positions within the block i are set by the backlight brightness value of one pixel position within the block i.

In some embodiments, the display driving apparatus drives liquid crystal molecules with corresponded deflection according to the n grayscale compensation values, the at least one program includes instructions of executing following steps:

The n grayscale integer values respectively corresponding to the n grayscale compensation values are determined in accordance with the n grayscale compensation values and a grayscale transformation formula.

The n grayscale integer values are transformed into n driving voltage parameters corresponding to the n grayscale integer values.

The liquid crystal molecules are driven with corresponded deflection according to the n driving voltage parameters.

The detail of this embodiment is referenced by the method above, it is omitted herein.

However, even though the embodiment of this disclosure is illustrated by the method, it can be understood, for the purpose of achieving the method above, the display driving apparatus can be implemented by hardware or software modules executed by a processor or a combination thereof. Professionals shall be able to further realize that the exemplary elements and algorithm steps described here in conjunction with the embodiments can be implemented by electronic hardware or computer software or a combination thereof, and in order to clearly illustrate the interchangeability between the hardware and software, the exemplary composition and steps have been generally described in terms of the functions in the above text. As for whether these functions are realized by hardware or software, it depends on the specific application of the technical solution as well as the restraints of the design. Professionals can use different methods to realize the described functions for each specific application, which shall not be deemed as beyond the scope of the present disclosure.

In addition, all function units in the embodiments of the disclosure may be fully integrated in one processing unit and each unit may also be respectively used as a separate unit, and two or more units may also be integrated in one unit; and the integrated units may be implemented by means of hardware and may also be implemented by means of hardware and software function units.

Figure 5:
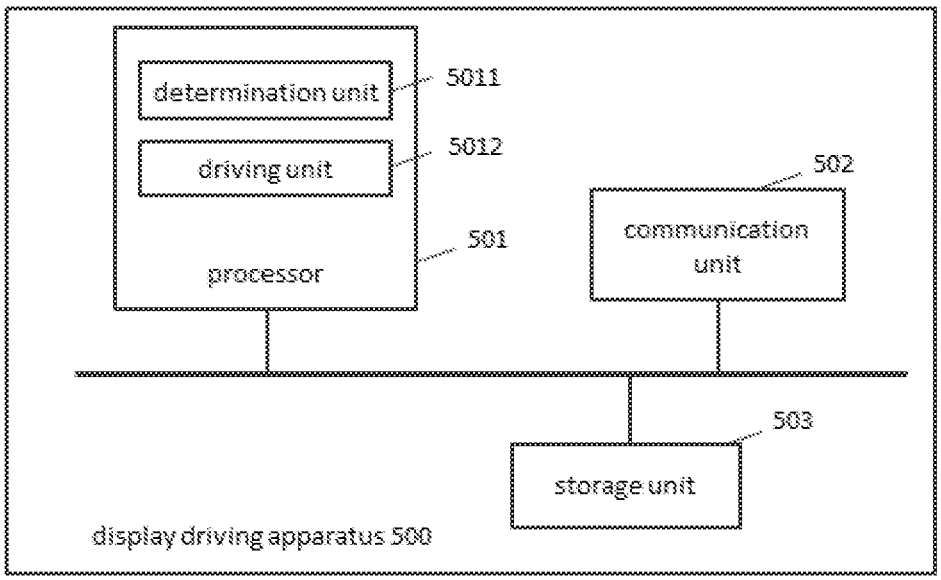
FIG. 5 is a structural schematic view of another display driving apparatus according to an embodiment of the disclosure.

Assumed that all function are fully integrated in one processing unit, FIG. 5 is shown as a structural schematic view of another display driving apparatus according to an embodiment of the disclosure. The display driving apparatus 500 includes a processor 501 a communication unit 502, and a storage unit 503. The processor 501 includes a determination unit 5011 and a driving unit 5012. The storage unit 503 is configured for storing the program code or data of the display driving apparatus. The communication unit 502 is configured for communicating between the display driving apparatus 500 and others. Some units said above (e.g., determination unit 5011 and driving unit 5012) are configured for executing the related steps of method above.

The determination unit 5011 is configured for determining n backlight brightness values respectively corresponding to n pixel positions of a screen-locked display area when the screen-locked display area lights up and determining n grayscale compensation values respectively corresponding to the n backlight brightness values in accordance with the n backlight brightness values and a grayscale compensation formula. Wherein n is an integer greater than 1.

The driving unit 5012 is configured for driving liquid crystal molecules with corresponded deflection according to the n grayscale compensation values.

In some embodiment, the display driving apparatus includes a backlight brightness sequence, the backlight brightness sequence comprises N backlight levels in respect with the screen-locked display area, N is an integer greater than 1; under a first backlight level of the N backlight levels, pixel position i is corresponding to backlight brightness value j, and the backlight brightness value j is corresponding to grayscale compensation value k; under a second backlight level of the N backlight levels, the pixel position i corresponds to backlight brightness value x, and the backlight brightness value x corresponds to grayscale compensation value y; the product of the backlight brightness value j and a transmittance corresponding to the grayscale compensation value k is equal to the product of the backlight brightness value x and a transmittance corresponding to the grayscale compensation value y, the first backlight level and the second backlight level are any two levels of the N backlight levels, and the pixel position i is any one of the n pixel positions.

In some embodiment, the backlight brightness sequence is configured in order by the N backlight brightness levels; the backlight brightness levels of the screen-locked display area are configured in a loop according to the backlight brightness sequence by the display driving apparatus; the lighted-up durations of different backlight brightness levels in respect with the screen-locked display area are the same.

In some embodiments, in the aspect of determining the n backlight brightness values respectively corresponding to the n pixel positions of the screen-locked display area, the determination unit 5011 is configured for executing following steps:

The n pixel positions are numbered; and the n backlight brightness values respectively corresponding to the n pixel positions of the screen-locked display area are determined in accordance with the number of the n pixel positions.

In some embodiments, in the aspect of determining the n backlight brightness values respectively corresponding to the n pixel positions of the screen-locked display area, the determination unit 5011 is configured for executing following steps:

the screen-locked display area is configured into M blocks, each block having a plurality of the pixel positions, total of the M blocks having the n pixel positions, wherein M is integer than 1; a backlight brightness value of one pixel position within the block I is determined, wherein the block i is any one of the M blocks; and all backlight brightness values of the pixel positions within the block i are set by the backlight brightness value of one pixel position within the block i.

In some embodiments, in the aspect of driving liquid crystal molecules corresponded deflection according to the n grayscale compensation values, the driving unit 5012 includes instructions of executing following steps:

The n grayscale integer values respectively corresponding to the n grayscale compensation values are determined in accordance with the n grayscale compensation values and a grayscale transformation formula.

The n grayscale integer values are transformed into n driving voltage parameters corresponding to the n grayscale integer values.

The liquid crystal molecules are driven with corresponded deflection according to the n driving voltage parameters.

In detail, the processor 501 can be realized by, for example, a processor or control unit such as Central Processing Unit (CPU), general purpose processor, Digital Signal Processor (DSP), Application-Specific Integrated Circuit (ASIC), Field Programmable Gate Array (FPGA), or other programmable logic circuit, transistor logic circuit, hardware component, or any combination thereof. It can implement or perform various exemplary logic blocks, modules, and circuits described in conjunction with the disclosure of the disclosure. The processor 501 may also be a combination that implements computational functions, for example, including one or more combinations of microprocessors, a combination of a DSP and a microprocessor, etc.). The storage unit 503 can be realized by, for example, storage, and the communication unit 502 can be by, for example, transceiver, transceiver circuit, RF chip, communication interface, or etc.

Embodiments of the disclosure further provide a liquid crystal display. The backlight brightness value is periodic changed when the liquid crystal display lights on a screen-locked state and each liquid crystal molecule corresponding to the pixel position are driven with the corresponded deflection by the grayscale compensation value. The liquid crystal display is operable to perform the method as described in example part or all of the steps of any of methods described.

Embodiments of the disclosure further provide a program storage medium storing a computer program used for interexchanging electric data. The program storage medium is operable to cause a computer to perform the method as described in example part or all of the steps of any of methods described. The computer program product may be a software installation package, and the computer includes a display driving apparatus.

Embodiments of the disclosure further provide a computer program product, the computer program product comprising a non-transitory computer stores a computer-readable program storage medium, the computer program operable to cause a computer to perform the method as described in example part or all of the steps of any of methods described. The computer program product may be a software installation package, and the computer includes a display driving apparatus.

It should be noted that: for each foregoing method embodiment, it is described as a series of action combination for simple description, however, persons skilled in the art should know that the embodiments of the disclosure are not limited by the described action order, because some steps may be performed in other orders or performed at the same time according to the embodiments of the disclosure. Second, persons skilled in the art should also know that, the embodiments described in the specification belong to exemplary embodiments, related actions and modules are not always necessary to the embodiments of the disclosure.

In the foregoing embodiments, the description of each embodiment has its own focus. For a part that is not described in detail in a certain embodiment, reference may be made to a related description in another embodiment.

In the embodiments provided by the present application, it should be understood that the disclosed apparatus may be implemented in other ways. The apparatus embodiment described above is just exemplary. For example, division of units is just a division by logic functions, other dividing ways may be adopted during actual implementation, e.g., a plurality of units or components may be combined or may be integrated in another system, or some features may be neglected or not executed. In addition, coupling, direct coupling or communication connection between the components which are illustrated or discussed may be indirect coupling or communication connection through some interfaces, apparatus or units, and may be electrical, mechanical or other forms.

Units which are described above as discrete parts may be or may also not be physically separated; parts illustrated as a unit may be or may also not be physical units, not only can be located at the same position, but also can be distributed at a plurality of network units; and partial or all units may be selected according to the actual needs to realize the purpose of the solution of the embodiment.

In addition, all function units in the embodiments of the disclosure may be fully integrated in one processing unit and each unit may also be respectively used as a separate unit, and two or more units may also be integrated in one unit; and the integrated units may be implemented by means of hardware and may also be implemented by means of hardware and software function units.

In the disclosure, if the integrated units are implemented by means of software function modules and are sold or used as independent products, the units may also be stored in a computer readable storage medium. Based on such understanding, the technical solution of the embodiment of the disclosure substantially or the portion which makes a contribution to the existing art may be reflected by means of software product, the computer software product is stored in a storage medium and includes a plurality of instructions which make a computer apparatus (which may be a personal computer, a server or a network apparatus) execute all or partial steps of the method provided by each embodiment of the disclosure. The foresaid storage medium includes various mediums capable of storing program codes, such as a mobile storage apparatus, a Read-Only Memory (ROM), a Random Access Memory (RAM), a magnetic disk or a compact disk, etc.

Or, one ordinary person skilled in the art can understand that all or partial steps in the above-mentioned method embodiments can be completed by relevant hardware instructed by a program, and the program can be stored in a computer readable storage medium, and when the program is executed, the steps in the above-mentioned method embodiments are executed; and the foresaid storage medium includes various mediums capable of storing program codes, such as a mobile storage apparatus, a Read-Only Memory (ROM), a Random Access Memory (RAM), a magnetic disk or a compact disk, etc.

The above-mentioned embodiments are just preferred embodiments of the disclosure and are not used for limiting the protection scope of the disclosure. One skilled in the art may easily conceive of variation or replacement within the technical range disclosed by the disclosure, but such variation or replacement should be included in the protection scope of the disclosure. Therefore, the protection scope of the disclosure shall be subjected to the protection scope of the claims.

What is claimed is:

1. A display driving method, comprising determining n backlight brightness values respectively corresponding to n pixel positions of a screen-locked display area when the screen-locked display area lights up, wherein n is an integer greater than 1;

determining n grayscale compensation values respectively corresponding to the n backlight brightness values in accordance with the n backlight brightness values and a grayscale compensation formula; and driving liquid crystal molecules with corresponded deflection according to the n grayscale compensation values;

wherein a display driving apparatus comprises a backlight brightness sequence, the backlight brightness sequence comprises N backlight brightness levels in respect with the screen-locked display area, N is an integer greater than 1;

under a first backlight brightness level of the N backlight brightness levels, pixel position i is corresponding to backlight brightness value j, and the backlight brightness value j is corresponding to grayscale compensation value k;

under a second backlight brightness level of the N backlight brightness levels, the pixel position i corresponds to backlight brightness value x, and the backlight brightness value x corresponds to grayscale compensation value y;

a product of the backlight brightness value j and a transmittance corresponding to the grayscale compensation value k is equal to a product of the backlight brightness value x and a transmittance corresponding to the grayscale compensation value y, the first backlight brightness level and the second backlight brightness level are any two levels of the N backlight brightness levels, and the pixel position i is any one of the n pixel positions.

2. The display driving method according to claim 1, wherein the backlight brightness sequence is configured in order by the N backlight brightness levels; the backlight brightness levels of the screen-locked display area are configured in a loop according to the backlight brightness sequence by the display driving apparatus; the lighted-up durations of different backlight brightness levels in respect with the screen-locked display area are the same.

3. The display driving method according to claim 1, wherein the step of determining the n backlight brightness values respectively corresponding to the n pixel positions of the screen-locked display area when the screen-locked display area lights up, further comprises:

numbering the n pixel positions; and determining the n backlight brightness values respectively corresponding to the n pixel positions of the screen-locked display area in accordance with the number of the n pixel positions.

4. The display driving method according to claim 1, wherein the step of determining the n backlight brightness values respectively corresponding to the n pixel positions of the screen-locked display area when the screen-locked display area lights up, further comprises:

configuring the screen-locked display area into M blocks, each block having a plurality of the pixel positions, total of the M blocks having the n pixel positions, wherein M is integer than 1;

determining a backlight brightness value of one pixel position within the block i, wherein the block i is any one of the M blocks; and setting all backlight brightness values of the pixel positions within the block i by the backlight brightness value of one pixel position within the block i.

5. The display driving method according to claim 1, wherein the step of driving liquid crystal molecules with corresponded deflection according to the n grayscale compensation values, further comprises:

determining n grayscale integer values respectively corresponding to the n grayscale compensation values in accordance with the n grayscale compensation values and a grayscale transformation formula;

transforming the n grayscale integer values into n driving voltage parameters corresponding to the n grayscale integer values; and driving the liquid crystal molecules with corresponded deflection according to then driving voltage parameters.

6. The display driving method according to claim 1, a liquid crystal display driven by the display driving method, wherein the backlight brightness value is periodic changed when the liquid crystal display lights on a screen-locked state, and each liquid crystal molecule corresponding to the pixel position are driven with the corresponded deflection by the grayscale compensation value.

7. The display driving method according to claim 1, wherein a computer-readable storage medium stores a computer program used for inter-exchanging electric data, and the computer executes the display driving method by the computer program.

8. The display driving method according to claim 1, wherein a computer program product comprises a non-transitory computer-readable storage media storing a computer program, and the computer executes the display driving method by the computer program.

9. A display driving apparatus, comprising:

a determination unit, configured for determining n backlight brightness values respectively corresponding to n pixel positions of a screen-locked display area when the screen-locked display area lights up, wherein n is an integer greater than 1; determining n grayscale compensation values respectively corresponding to the n backlight brightness values in accordance with the n backlight brightness values and a grayscale compensation formula; and a driving unit, configured for driving liquid crystal molecules with corresponded deflection according to the n grayscale compensation values;

wherein the display driving apparatus comprises a backlight brightness sequence, the backlight brightness sequence comprises N backlight brightness levels in respect with the screen-locked display area, N is an integer greater than 1;

under a first backlight brightness level of the N backlight brightness levels, pixel position i is corresponding to backlight brightness value j, and the backlight brightness value j is corresponding to grayscale compensation value k;

under a second backlight brightness level of the N backlight brightness levels, pixel position i corresponds to backlight brightness value x, and the backlight brightness value x corresponds to grayscale compensation value y;

a product of the backlight brightness value j and a transmittance corresponding to the grayscale compensation k is equal to a product of the backlight brightness value x and a transmittance corresponding to the grayscale compensation y, the first backlight brightness level and the second backlight brightness level are any two levels of the N backlight brightness levels, and the pixel position i is any one of the n pixel positions.

10. The display driving apparatus according to claim 9, wherein the backlight brightness sequence is configured in order by the N backlight brightness levels; the backlight brightness levels of the screen-locked display area are configured in a loop according to the backlight brightness sequence by the display driving apparatus; the lighted-up durations of different backlight brightness levels in respect with the screen-locked display area are the same.

11. The display driving apparatus according to claim 9, wherein in the operation of determining the n backlight brightness values respectively corresponding to the n pixel positions of the screen-locked display area when the screen-locked display area lights up, the determining unit further comprises:

numbering the n pixel positions; and determining the n backlight brightness values respectively corresponding to the n pixel positions of the screen-locked display area in accordance with the number of then pixel positions.

12. The display driving apparatus according to claim 9, wherein in the operation of determining the n backlight brightness values respectively corresponding to the n pixel positions of the screen-locked display area when the screen-locked display area lights up, the determining unit further comprises:

configuring the screen-locked display area into M blocks, each block having a plurality of the pixel positions, total of the M blocks having the n pixel positions, wherein M is integer than 1;

determining a backlight brightness value of one pixel position within the block i, wherein the block i is any one of the M blocks; and setting all backlight brightness values of the pixel positions within the block i by the backlight brightness value of one pixel position within the block i.

13. The display driving apparatus according to claim 9, wherein in the operation of driving liquid crystal molecules with corresponded deflection according to the n grayscale compensation values, the driving unit further comprises:

determining n grayscale integer values respectively corresponding to the n grayscale compensation values in accordance with the n grayscale compensation values and a grayscale transformation formula;

transforming the n grayscale integer values into n driving voltage parameters corresponding to the n grayscale integer values; and driving the liquid crystal molecules with corresponded deflection according to the n driving voltage parameters.

14. The display driving apparatus according to claim 9, wherein the display driving apparatus further comprises: at least one processor, at least one storage, at least one transceiver, and at least one program, wherein the at least one program is stored in the at least one storage and executed by the at least one processor.

* * * * *